US009237977B2

(12) United States Patent
Sithian

(10) Patent No.: US 9,237,977 B2
(45) Date of Patent: Jan. 19, 2016

(54) SUPPORT FOR RELIEF OF PRESSURE ULCERS

(71) Applicant: Nedunchezian Sithian, Staten Island, NY (US)

(72) Inventor: Nedunchezian Sithian, Staten Island, NY (US)

( * ) Notice: Subject to any disclaimer, the term of this patent is extended or adjusted under 35 U.S.C. 154(b) by 0 days.

(21) Appl. No.: 14/491,032

(22) Filed: Sep. 19, 2014

(65) Prior Publication Data

US 2015/0283014 A1 Oct. 8, 2015

Related U.S. Application Data

(63) Continuation-in-part of application No. 14/248,007, filed on Apr. 8, 2014.

(51) Int. Cl.

| | |
|---|---|
| ***A47C 20/00*** | (2006.01) |
| ***A61G 7/057*** | (2006.01) |
| ***A47G 9/02*** | (2006.01) |
| ***A61G 7/07*** | (2006.01) |
| ***A47G 9/10*** | (2006.01) |

(52) U.S. Cl.

CPC ..... *A61G 7/057* (2013.01); *A47G 9/0238* (2013.01); *A47G 9/0253* (2013.01); *A47G 9/1027* (2013.01); *A61G 7/072* (2013.01); *A47G 2009/1018* (2013.01)

(58) Field of Classification Search

CPC . A47G 9/0207; A47G 9/0223; A47G 9/0238; A47G 9/0246; A47G 9/0253; A47G 9/10; A47G 2009/1018

See application file for complete search history.

(56) References Cited

U.S. PATENT DOCUMENTS

| | | | | |
|---|---|---|---|---|
| 2,895,146 | A * | 7/1959 | Lester | 5/490 |
| 3,984,886 | A * | 10/1976 | Keeton | A47C 4/54 297/284.3 |
| 4,021,870 | A * | 5/1977 | Walters | 5/484 |
| 4,064,577 | A * | 12/1977 | Walters | 5/484 |
| 4,391,010 | A * | 7/1983 | Kronman | 5/484 |
| 4,599,756 | A * | 7/1986 | Koffler | 5/484 |
| 4,614,000 | A | 9/1986 | Mayer | |
| 4,627,122 | A * | 12/1986 | Hopp | 5/484 |
| 4,791,687 | A * | 12/1988 | Iwase | 5/708 |
| 4,924,543 | A * | 5/1990 | Hoss et al. | 5/484 |
| 5,044,030 | A * | 9/1991 | Balaton | A47C 27/081 297/DIG. 3 |
| 5,221,273 | A * | 6/1993 | Graham | 604/358 |
| 5,364,339 | A | 11/1994 | Carver | |
| 5,678,266 | A * | 10/1997 | Petringa | A47C 7/021 297/219.1 |
| 5,787,523 | A * | 8/1998 | Lindberg | 5/81.1 HS |
| 5,916,664 | A * | 6/1999 | Rudy | A41D 31/0044 2/161.1 |

(Continued)

OTHER PUBLICATIONS

"Hospital Bed Sizes—Hospital Matress Sizing—Hospital Bed Sheets Measurements", Hospital Bedexpert, downloaded Mar. 21, 2014, available at http;://www.hospitalbedexpert.com/hospital-bed-mattress-sheets-sizing-guide.html.

*Primary Examiner* — David E Sosnowski

(74) *Attorney, Agent, or Firm* — Gordon & Jacobson, P.C.

(57) ABSTRACT

A support for use with a pillow on a mattress and a method for use thereof are disclosed. The support includes a sham extending longitudinally along an axis. The sham has a sleeve having two or three substantially closed sides and one or two substantially open sides. The sham has extensions extending longitudinally from the sleeve. The extensions are constructed to extend around sides and at least a portion of the bottom of a mattress. The sleeve is constructed to receive a pillow therein. The method includes providing such a sham and extending the extensions around the sides and under a portion of the mattress.

19 Claims, 7 Drawing Sheets

(56) References Cited

U.S. PATENT DOCUMENTS 5,996,147 A * 12/1999 Trimble ..... 5/482
6,049,925 A * 4/2000 Lewis ..... 5/497
6,233,762 B1 * 5/2001 Bradley ..... 5/484
6,286,163 B1 * 9/2001 Trimble ..... 5/485
6,487,738 B1 * 12/2002 Graebe ..... A47C 23/043 267/82
6,490,743 B1 * 12/2002 Adat et al. ..... 5/645
6,539,565 B1 * 4/2003 Trimble ..... 5/485
6,585,673 B1 7/2003 Bass
6,845,532 B1 * 1/2005 Rosenblum ..... 5/482
6,892,734 B1 5/2005 Schleicher et al.
7,584,515 B2 9/2009 Jones et al.
7,971,292 B1 * 7/2011 Sithian ..... 5/485
8,052,630 B2 11/2011 Kloecker et al.
8,307,476 B1 * 11/2012 Weaver et al. ..... 5/417
8,347,429 B1 * 1/2013 Hawkins ..... 5/424
8,516,631 B1 * 8/2013 Conley ..... 5/482
8,566,983 B2 10/2013 Monaco
8,607,382 B1 12/2013 Cohron, III
8,776,798 B2 * 7/2014 Choi ..... A61F 13/069 128/845
8,832,877 B2 * 9/2014 Pillay ..... 5/487
D719,377 S * 12/2014 Keever ..... D6/606
8,950,025 B2 * 2/2015 Kaminski, Jr. ..... 5/498
2004/0107502 A1 * 6/2004 Boone ..... 5/636
2004/0199999 A1 * 10/2004 Landry ..... 5/494
2005/0060808 A1 * 3/2005 Shaw ..... 5/649
2005/0102757 A1 * 5/2005 Lee ..... 5/636
2007/0295773 A1 * 12/2007 Wegenhoft ..... 224/576
2009/0013466 A1 * 1/2009 Yates et al. ..... 5/490
2009/0205133 A1 * 8/2009 Thomas ..... 5/485
2009/0205134 A1 * 8/2009 Wootten, Jr. ..... 5/488
2009/0229054 A1 * 9/2009 Yates et al. ..... 5/490
2010/0122413 A1 * 5/2010 McNair ..... 5/485
2010/0275373 A1 * 11/2010 Kaplan et al. ..... 5/494
2011/0113550 A1 * 5/2011 Lafoux ..... 5/413 R
2011/0119832 A1 * 5/2011 Hung ..... 5/655
2011/0265261 A1 * 11/2011 Ogundare ..... 5/485
2011/0302713 A1 * 12/2011 Martenson ..... 5/482
2012/0137433 A1 * 6/2012 Snell et al. ..... 5/493
2012/0180214 A1 * 7/2012 Borgione ..... 5/485
2013/0139321 A1 * 6/2013 McCausland ..... A61G 7/05769 5/652.2
2013/0167297 A1 * 7/2013 Kaminski, Jr. ..... 5/498
2013/0180530 A1 * 7/2013 Choi ..... A61G 7/05776 128/889
2013/0189898 A1 * 7/2013 Abbott ..... 446/73
2014/0013507 A1 * 1/2014 Perez ..... 5/485
2014/0020185 A1 * 1/2014 Wang ..... A47C 7/021 5/652.1
2014/0259405 A1 * 9/2014 Lacasse ..... 5/485

* cited by examiner

SUPPORT FOR RELIEF OF PRESSURE ULCERS

This is a continuation-in-part of co-owned U.S. Ser. No. 14/248,007 entitled Support for Relief of Pressure Ulcers, filed Apr. 8, 2014, which is hereby incorporated by reference herein in its entirety.

BACKGROUND

1. Field

The following disclosure relates broadly to supports having retention elements for use on a mattress where the supports can be used for relieving or avoiding the development of pressure ulcers. More particularly, the disclosure relates to supports that are easily arranged and deployed for the avoidance of heel ulcers and sacral decubitus, and methods of using the same.

2. State of the Art

In settings such as rehabilitation centers, hospitals, and nursing homes, patients are frequently bedridden. Bedridden patients, the elderly, and anyone else whose mobility is highly limited often develop foot, leg, and back ulcers due to poor blood circulation resulting from narrowed arteries and damage to small blood vessels caused by diseases such as long-standing diabetes, and by the sheer weight of portions of the body on the bed. Ulcers are breaks in the layers of the skin that fail to heal due to poor circulation and regeneration of tissue, and often progress in these patients. Pressure ulcers can lead to gangrene and complications thereof. Treatment of such ulcers can also be very costly.

Reducing the extent of contact between the back and buttocks of a patient and a mattress can help to prevent onset of sacral decubitus in the sacral region and can assist the patient's body in healing in the sacral area. Also, reducing the extent of contact between the heel and a mattress can help prevent onset of pressure ulcers in the heel region and can assist the patient's heel in healing.

SUMMARY

According to one aspect, a support for use with a pillow on a mattress includes a sham extending longitudinally along an axis with the sham having a longitudinal pocket having two or three substantially closed sides and one or two at least partially open sides, and extensions (flaps) extending longitudinally from the pocket that are constructed to wrap around sides and at least a portion of the bottom of the mattress. The longitudinal pocket is constructed to receive a pillow therein. For purposes herein, the term "pillow" is to be understood to be broad and encompass both a traditional cloth bag stuffed with foam, feathers, or other soft material, as well as other cushioning or bolstering elements such as air cushions that can provide support or elevation for a body part.

In another aspect, a method of fixing a support to a mattress includes providing a support having a sham extending longitudinally along an axis where the sham has a pocket having two or three substantially closed sides and one or two at least partially open sides, and extensions (flaps) extending longitudinally from the pocket, inserting a pillow through the one at least partially open side of the pocket into the pocket, and wrapping the extensions around sides and at least a portion of the bottom of the mattress.

In one embodiment, the pocket extends substantially across the entire width of a typical hospital bed mattress. In one embodiment, the at least one partially open side of the pocket is perpendicular to the long axis of the pocket. In another embodiment, the at least one partially open side of the pocket is parallel to the long axis of the pocket.

In one embodiment, a pillow for use with the support is substantially the same length and width of the pocket. In one embodiment particularly useful for preventing or treating heel ulcers, the pillow is at least approximately six inches high and is made either of dense foam that does not substantially collapse or of a plastic bubble-wrap-type material that is rolled into a bolster of at least approximately six inches high. In another embodiment particularly useful for preventing or treating sacral decubitis, the pillow is approximately one inch high where it is intended to extend under a buttocks of a patient, and approximately two inches high where it is intended to extend under the small of the back of the patient.

According to one aspect, the length of the support (perpendicular the long axis) is sufficiently small such that the support may be located and moved along the length of a mattress to a desired location depending upon the height of the patient and the location of the ulcer on the patient.

A more complete understanding will become apparent to those skilled in the art upon reference to the detailed description taken in conjunction with the provided figures.

DETAILED DESCRIPTION

Figure 1:
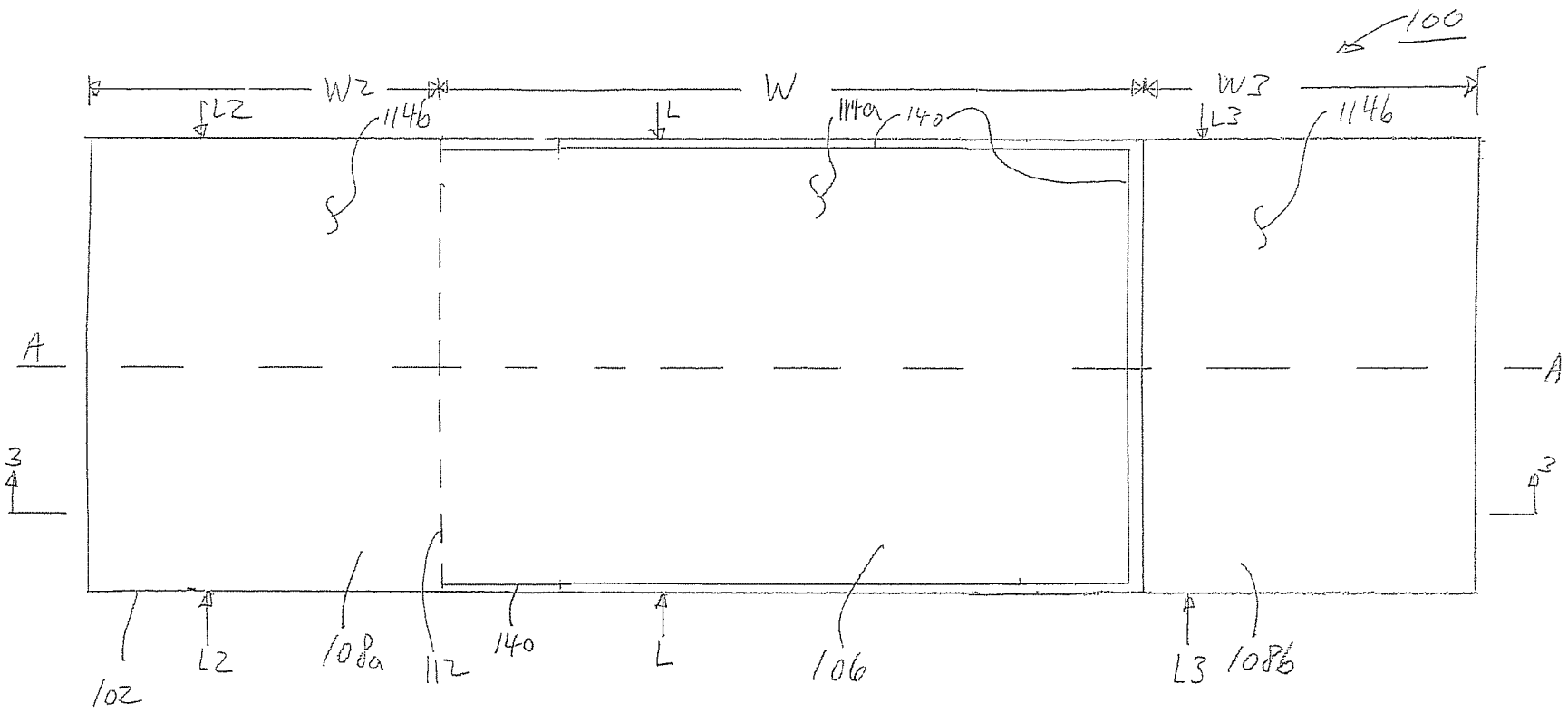
FIG. 1 is a top plan view of a support in accordance with one embodiment.

FIG. 1 shows an embodiment of a support 100. The support 100 includes a sham 102 that is arranged to receive a pillow 104 (FIGS. 4 and 5) positionable in a pocket or sleeve 106 of the sham 102. The sham 102 includes a pair of extensions or flaps 108*a*, 108*b* that extend axially from opposite sides of the pocket 106 along longitudinal axis A-A. The pocket 106 has a side opening 112 perpendicular to longitudinal axis A-A through which the pillow 104 is introduced. The pocket 106 has three substantially closed sides and one substantially open side and is constructed to receive and retain the pillow 104.

In one embodiment, the sham is formed by laying one layer of material 114*a* (FIGS. 1 and 3) atop a larger layer of material 114*b* (FIGS. 1 and 3) and stitching them together on three sides to form seam 140, thereby creating the pocket 106 with the side opening 112.

The pocket 106 has a width (W), which, in at least one embodiment, is substantially equal to the width of a hospital bed mattress. For example, the width (W) of the pocket 106 can be between substantially 28 and 39 inches. Typically, for most hospital-type beds, the width (W) of the pocket will be substantially 30 or 36 inches. In one embodiment, the pocket 106 has a length (L) between substantially 18 and 23 inches.

Figure 2:
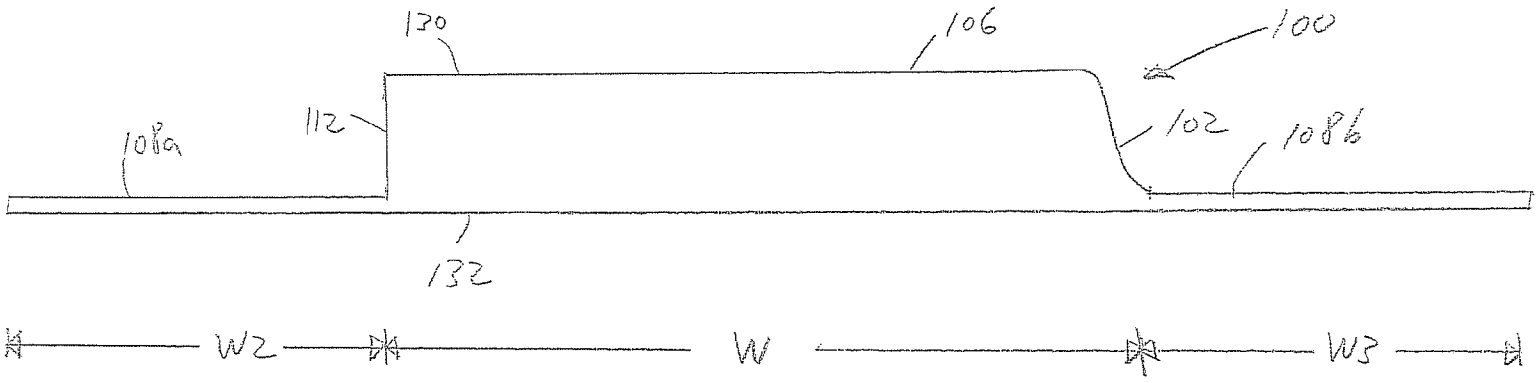
FIG. 2 is a front side elevation view of the support shown in FIG. 1.
Figure 3:
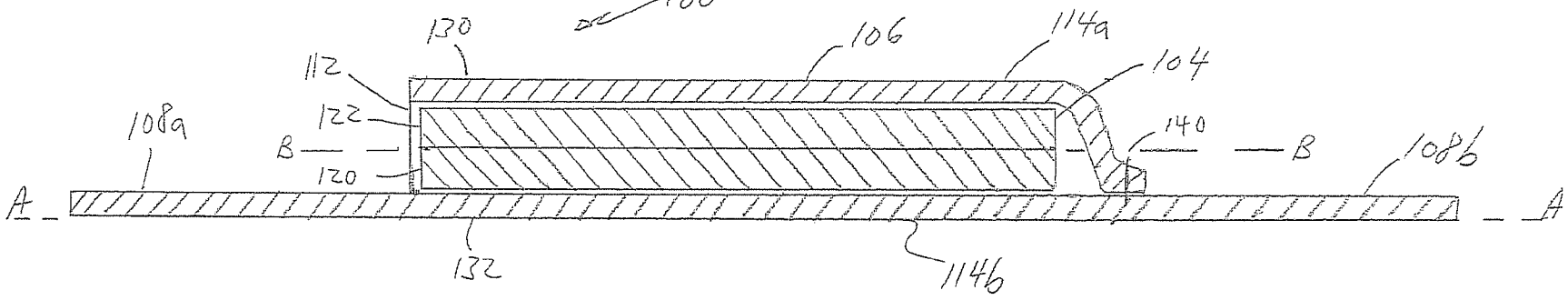
FIG. 3 is a section view of the support of FIG. 1 along section 3-3 in FIG. 1.

FIG. 2 shows a front side elevation view of the support 100 and FIG. 3 shows a view of the support 100 along section 3-3 in FIG. 1. In one embodiment the lengths (L2) and (L3) of each of the extensions 108*a*, 108*b* can be between 18 and 23 inches. In one other embodiment, the lengths (L2) and (L3) of the extensions 108*a*, 108*b* are the same as the length (L) of the pocket 106. In one embodiment, the combined (added) width of the widths (W2) and (W3) of the extensions 108*a*, 108*b* is substantially equal to the width (W) of the pocket 106. In one embodiment, the widths (W2) and (W3) of the extensions 108*a*, 108*b* are the same. In one embodiment, the combined widths (W2) and (W3) of the extensions 108*a*, 108*b* and the width (W) of the pocket 106 is between 62 and 84 inches. Generally, the pocket width is chosen to extend across the width of the mattress, and the extensions are sized to extend around the sides of the mattress and far enough under the mattress such that the weight of the patient on the mattress and therefore on the support extensions will prevent the support from being displaced from its intended position under the patient. Thus, in one embodiment, the extensions are sized to extend around the sides of the mattress and under at least a majority of the width of the bottom of the mattress.

Figure 4:
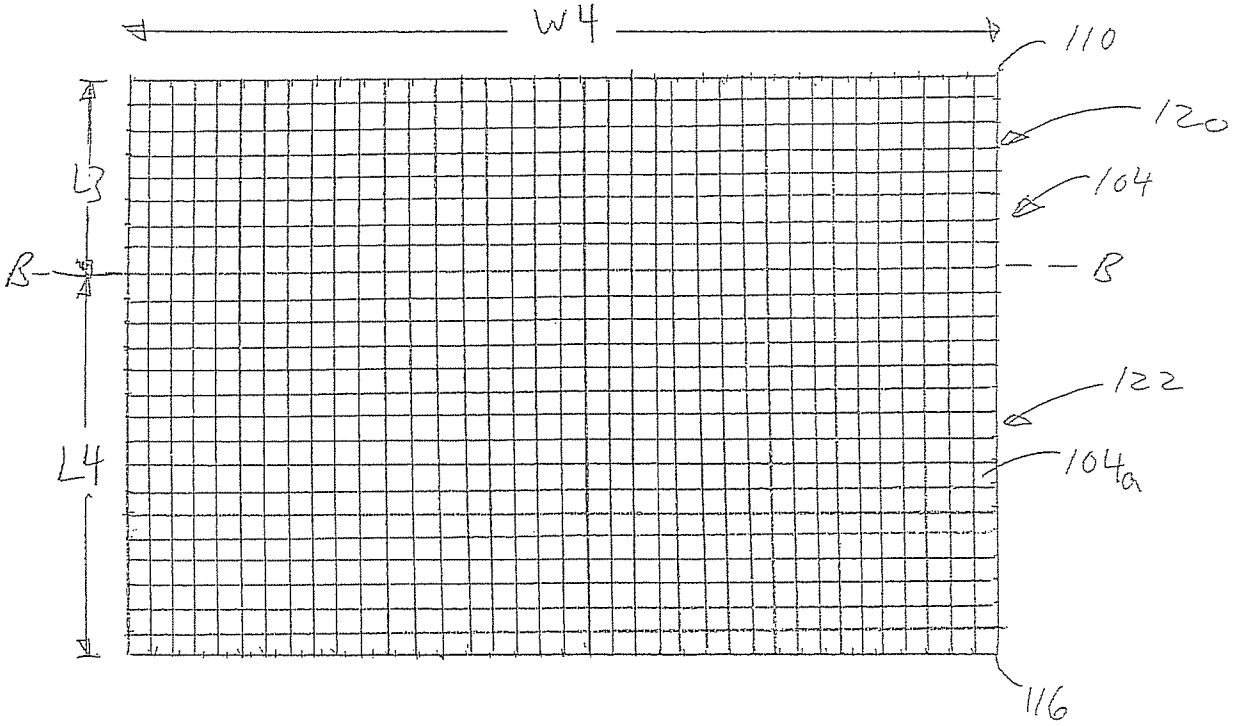
FIG. 4 is a top plan view of an embodiment of a pillow.

FIG. 4 shows a top plan view of one pillow 104 particularly useful for preventing or relieving sacral decubitis. Pillow 104 is shown as being formed of an air cushion material having a plurality of regularly spaced air cells 104*a* arranged in a grid or matrix. Each air cell 104*a* is formed of a pair of oppositely spaced layers of plastic that are sealed together forming a pocket that is filled with air or other inert gas. In one embodiment, each air cell 104*a* is about 1.5 inches wide and 2 inches in length and 1 inch thick (high). The air cells 104*a* are constructed so that when a portion of the patient's body lies on the cushion, the air cells 104*a* will distribute the applied weight without the air cells 104*a* being becoming fully compressed (i.e., the air pressure is large enough to prevent opposing inner walls of the cells from contacting each other).

In at least one embodiment, the air cushion material is bent or formed to curve into a desired shape. For example, in the embodiment shown in FIGS. 4 and 5, the air cushion material is curved to conform to curves of the back and/or buttocks of a patient to relieve or prevent onset of sacral decubitus. In the embodiment shown in FIGS. 4 and 5, the pillow has a curved portion 120 and a generally flat portion 122. The curved portion 120 may be formed by taking a first end 110 and folding it back over a portion of the body of the pillow and attaching it along axis B-B, e.g., by thermal welding. In this way, at least some of the curved portion 120 will be at least twice the height of the flat portion 122. The flat portion 122 extends from axis B-B to a second end 116. The total length (L3) of the curved portion 120 and the length (L4) of the flat portion 122 is less than or equal to the length (L) of the pocket 106. For example, in one embodiment, the length (L3) of the curved portion 120 is about 6 inches and the length (L4) of the flat portion 120 is about 12 inches and the length (L) of the pocket is 18 inches. Also, the pillow 104 has a width (W4) that is less than or equal to the width (W) of the pocket 106 of sham 102. As shown in FIG. 3, the pillow 104 is disposed in the pocket 106 so that axis B-B is parallel to axis A-A.

Figure 5:
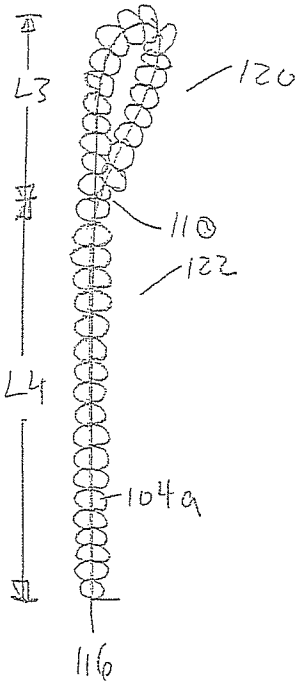
FIG. 5 is a side elevation view of the pillow shown in FIG. 4.

In use, the pillow 104 is inserted into the pocket 106 through opening 112 and the support 100 is placed horizontally across the top of the mattress (not shown) of a bed (not shown) so that the pocket 106 and the pillow 104 are positioned between the sides of the mattress. Typically, the sham and pillow are located underneath a bottom sheet that is used to cover the mattress. The support 100 may be placed so that a top surface 130 (FIGS. 2 and 3) is face down on the mattress and a bottom surface 132 (FIGS. 2 and 3) is face up on the bed. Also, the support 100 is oriented so that the curved portion 120 of the pillow 104 is directed toward the head end of the bed and the flat portion 122 is directed toward the foot end of the bed. The extensions 108*a*, 108*b* are wrapped around the sides of the mattress and tucked under at least a portion of the bottom of the mattress to retain the support 100 in place with respect to the mattress. When the support 100 is so positioned, a patient can lay over the support 100 on the mattress and be supported by the pillow 104 in the pocket 106. More specifically, when the pillow 104 is formed as shown in FIGS. 4 and 5, the support 100 can be located across the mattress at an appropriate position along the length of the mattress so that the curve of the lower back of the patient is located over the curved portion 120 and the position of the buttocks of the patient is located over the flat portion 122 to cushion those portions to relieve or avoid the development of sacral decubitus. Furthermore, with the extensions 108*a*, 108*b* so wrapped around the mattress, it will be appreciated that extension 108*a* blocks opening 112 so that the pillow 104 is retained in the pocket 106 and cannot be removed from the pocket 106 without untucking the extension 108*a*. If needed, the entire support can be slid up or down the length of the mattress to an appropriate position. In one embodiment, the layers of material 114*a*, 114*b* are formed of a material that permits the sham to slide easily over the mattress and under a bottom sheet on the mattress. For example, the layers 114*a* and 114*b* can be formed of a synthetic material such as nylon.

In another embodiment, the support 100 is placed so that a top surface 130 is face up on the bed and a bottom surface 132 is face down on the mattress and the extensions 108*a*, 108*b* are wrapped around the sides of the mattress and tucked under at least a majority of the width of the bottom of mattress. With the extensions 108*a*, 108*b* so wrapped around the mattress, it will be appreciated that access to the pillow 104 is not blocked by extension 108*a*, thus permitting insertion and removal of the pillow 104 from the pocket 106 without untucking the extension 108*a*.

The extensions 108*a*, 108*b* may include fasteners for attachment to each other or to mating fasteners on a bed or the sheets on the bed. For example, in one embodiment, the extensions 108*a*, 108*b* include snap closures or hook and loop fasteners (not shown) such that the extensions can wrap around the mattress and the closures or fasteners can connect to each other. Also, instead of connecting the extensions 108*a*, 108*b* together, in at least one other embodiment, the bed (not shown) includes fasteners that can connect to fasteners on the extensions 108*a*, 108*b*.

In one embodiment, the sham 102 is made from a material that can be cleaned with antiseptic solution without being laundered with hospital bed linen. In one embodiment, the sham 102 is made of a synthetic material, such as polyester or nylon, which may be cleaned with an antiseptic such as an alcohol wipe and which may also be laundered. Such a sham has the added benefit as previously disclosed of being easily slid under and over a mattress (and under sheets).

Figure 6:
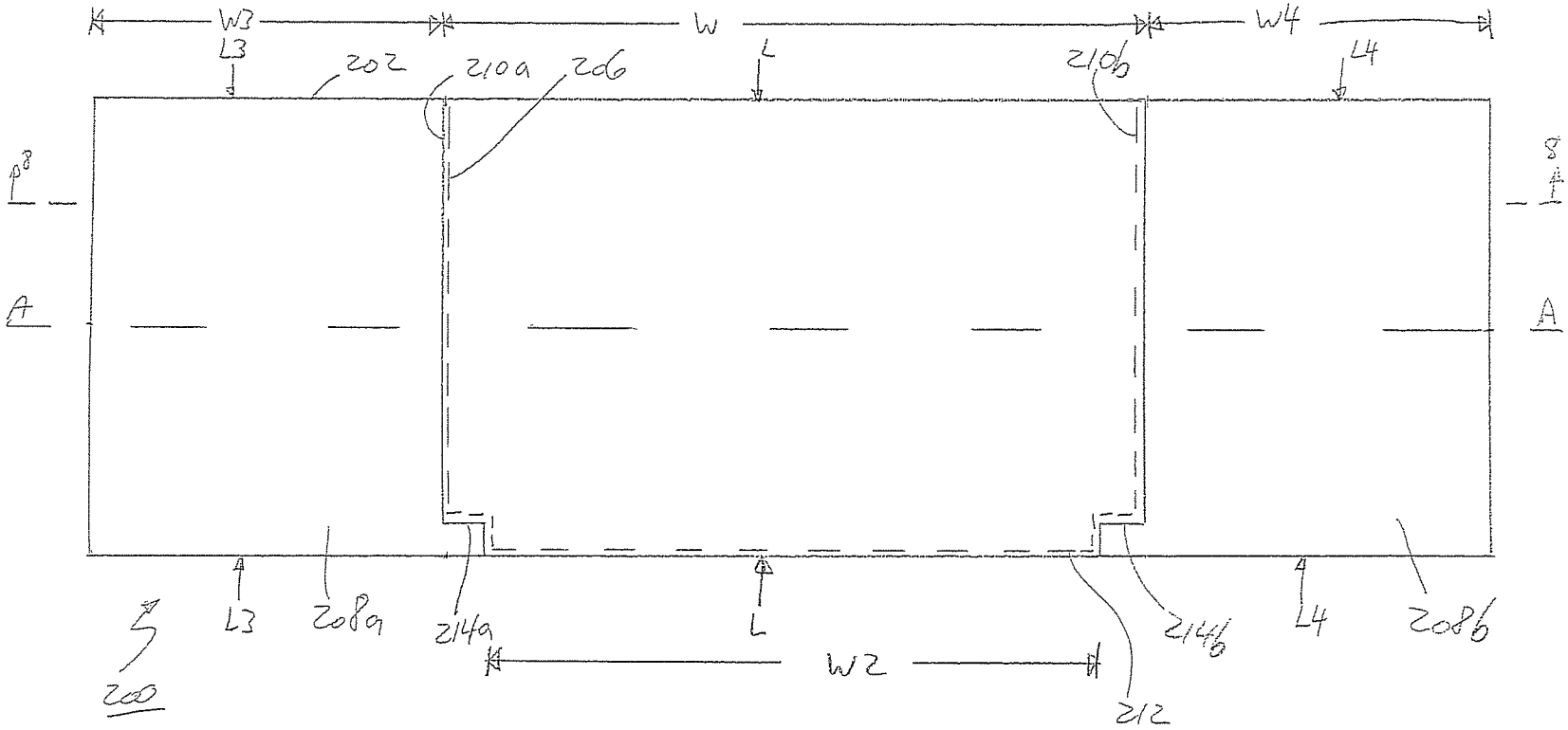
FIG. 6 is a top plan view of a leg support in accordance with an embodiment.
Figure 7:
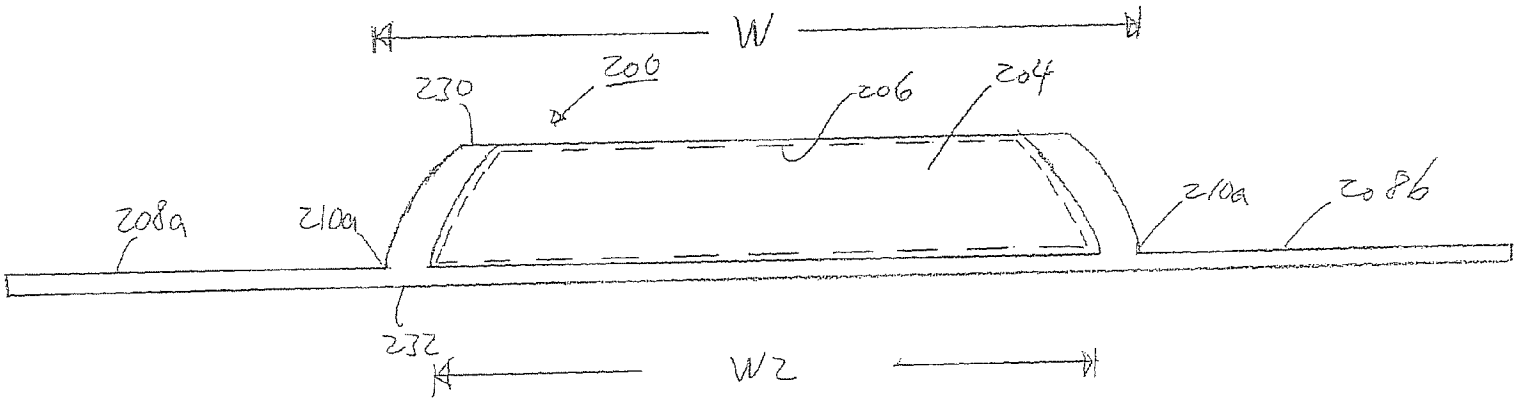
FIG. 7 is a front side elevation view of the leg support shown in FIG. 6.

FIG. 6 shows another embodiment of a support 200. The support 200 includes a sham 202, which is constructed to receive and retain a pillow 204 (FIGS. 6 and 7). The sham 202 includes a pair of extensions 208*a*, 208*b* that extend axially along longitudinal axis A-A from opposite sides of a pocket 206 formed by a first layer 230 and a second layer 232. Layers 230 and 232 are connected together along side seams 210*a* and 210*b*. The extensions extend substantially from side seams 210*a*, 210*b*.

The pocket 206 is constructed to receive and retain the pillow 204. The pocket 206 has a width (W) in the axial direction, which, in at least one embodiment, is less than or equal to the width of a hospital bed mattress. For example, in one embodiment the width (W) of the pocket 206 can be between 29 and 39 inches. In one embodiment, the pocket 206 has a length (L), in a direction transverse to the axial direction, which is between 18 and 23 inches.

Also, the pocket 206 has a front opening 212 through which the pillow 204 can be introduced. Retention seams 214*a*, 214*b* are stitched proximate to the front opening 212 making the width (W2) of the front opening 212 less than the width (W) between the side seams 210*a*, 210*b*. In one embodiment, the retention seams 214*a*, 214*b* are about 3 to 4 inches long and are spaced about 2 to 3 inches rearward from the front opening 212.

Figure 8:
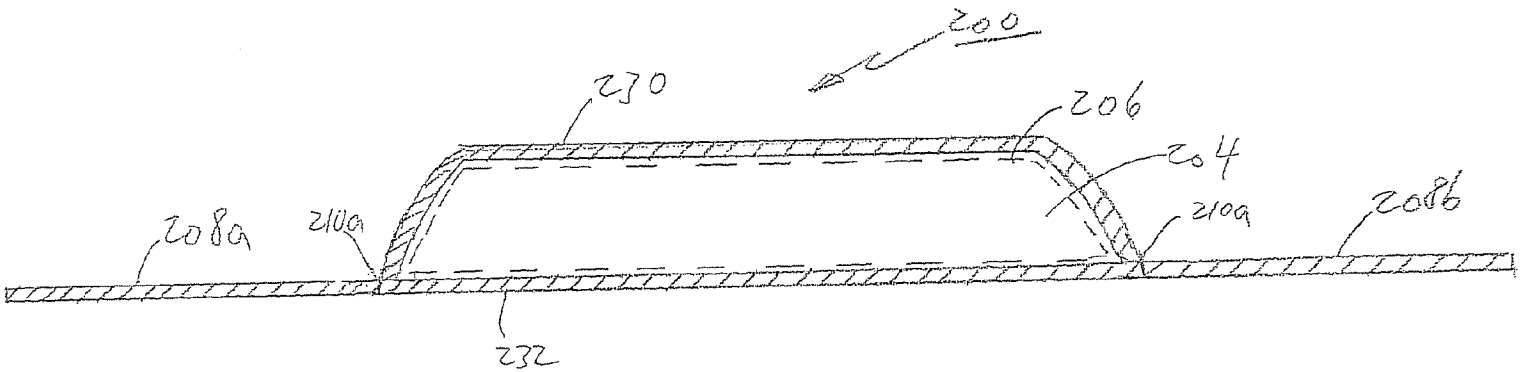
FIG. 8 is a section view of the leg support of FIG. 6 along section 8-8 in FIG. 6.

FIG. 7 shows a front side elevation view of the support 200 and FIG. 8 shows a view of the support 200 along section 8-8 in FIG. 6, which is rearward of retention seams 214*a*, 214*b*. It will be appreciated that the front opening 212 is constricted by the retention seams 214*a*, 214*b*. Once the pillow 204 is fully positioned in the pocket 206 and clears the retention seams 214*a*, 214*b*, the retention seams 214*a*, 214*b* inhibit movement of the pillow 206 out of the pocket, such as might be caused by the movements of a patient lying on the pillow 204.

Moreover, to further facilitate retention of the pillow 204 in the pocket 206, the pillow 204 and the pocket 206 are similarly dimensioned so that there is little relative movement between the pillow 204 and the sham 202 when the pillow 204 is inside the pocket 206. For example, in one embodiment, the width of the pillow 204 can be between substantially 28 and 39 inches, the length can be between substantially 18 and 23 inches, and the depth (height) can be about 5 to 10 inches. In one embodiment the pillow is 28 inches wide, 18 inches long, and 6 inches deep (high), and is used in a sham having a pocket that is 29 inches wide, 23 inches long, and 6 inches deep.

In one embodiment, the lengths (L3) and (L4) of the extensions 208*a*, 208*b* is the same as the length (L) of the pocket 206. Thus, the length of the extensions 208*a*, 208*b* can be between 18 and 23 inches. Also, in one embodiment the combined widths (W2) and (W3) of the extensions 208*a*, 208*b* is at least equal to the width (W) of the pocket 206 between the side seams 210*a*, 210*b*. Moreover, in one embodiment the ratio of the width (W) of the pocket 206 to the overall width of the sham is approximately equal to or less than 1:2. In one embodiment, the combined width of the extensions 208*a*, 208*b* and the pocket 206 is between 62 and 84 inches. The ratio of the total width of the sham 202 (i.e., combined width of the extensions 208*a*, 208*b* and the pocket 206) to the length (L) of the pocket 206 is at least 3:1. In one embodiment the widths (W2) and (W3) of extensions 208*a*, 208*b* are the same.

In one embodiment, pillow 204 is formed from a latex or a polyester foam that will not compress more than about 50% of its height. In another embodiment, pillow 204 is formed from an air cushion material having a plurality of regularly spaced air cells arranged in a grid or matrix which is rolled into a bolster.

In use, the pillow 204 (optionally placed into a pillowcase) is inserted into the pocket 206 of the sham 202 and the support 200 is placed horizontally across the mattress of a bed so that the pocket 206 and the pillow 204 are positioned between the sides of mattress. The extensions 208*a*, 208*b* are then wrapped around and tucked under the mattress to retain the support 200 in place with respect to the mattress. When the support 200 is so positioned, for example, a patient can lay over the support 200 on the mattress with legs supported by the pillow 204 in the pocket 206, thereby preventing pressure on the heels of the patient. Of course, it will be appreciated that the sham 202 can also be positioned with extensions 208*a*, 208*b* located under the mattress with the pillow being initially removed from the pocket 206 and subsequently inserted.

The extensions 208*a*, 208*b* may include fasteners (not shown) for attachment to each other or to mating fasteners on a bed or the sheets on the bed (not shown). For example, in one embodiment, the extensions 208*a*, 208*b* include snap closures or hook and loop fasteners such that the extensions can wrap around the mattress and the closures or fasteners can connect to each other. Also, instead of connecting the extensions 208*a*, 208*b* together, in at least one other embodiment, the bed includes fasteners that can connect to fasteners on the extensions 208*a*, 208*b*.

In one embodiment, the sham 202 is made from a material that can be cleaned with antiseptic solution without having to be laundered with hospital bed linen. In one embodiment, the sham 202 is made of a synthetic material, such as polyester or nylon, which may be cleaned with an antiseptic such as an alcohol wipe and which may also be laundered and which may be easily slid under a mattress and over a sheet.

In one aspect, it will be appreciated that by providing a sham with a pocket for a pillow that extends across substantially the entire width of a mattress, the patient cannot position him/herself intentionally or unintentionally to avoid the support.

Figure 9:
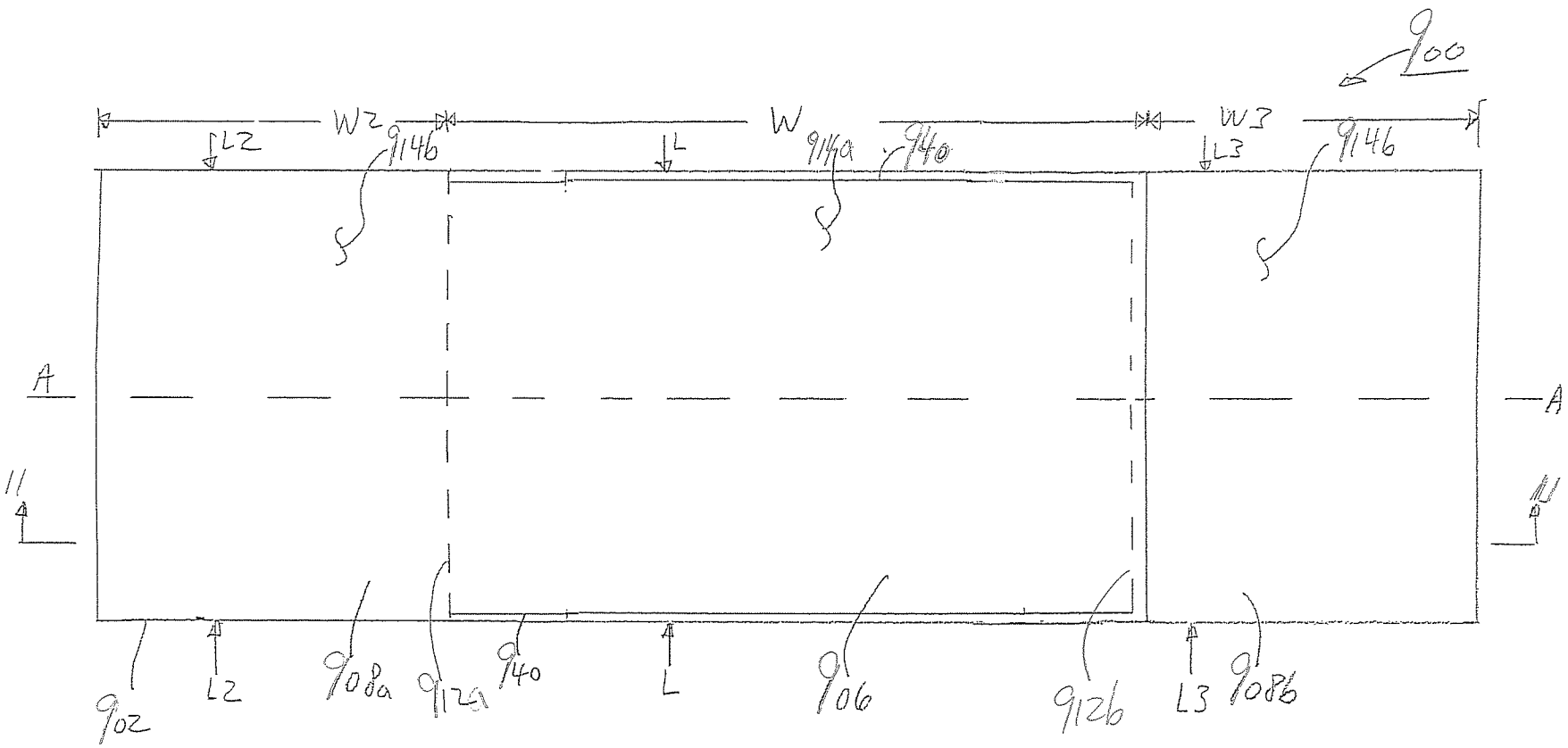
FIG. 9 is a top plan view of another embodiment of a support.
Figure 10:
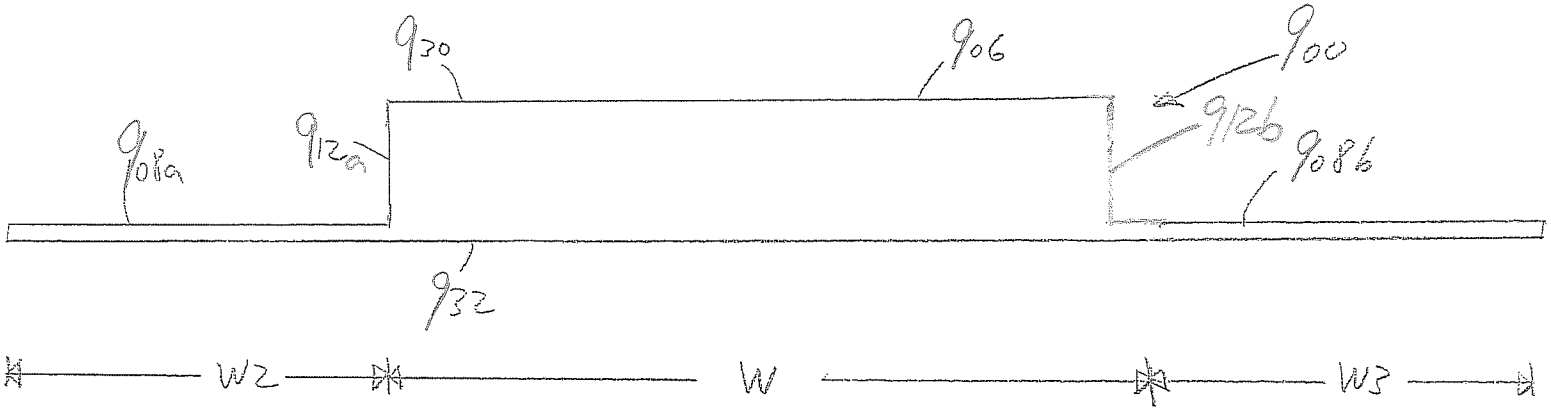
FIG. 10 is a front side elevation view of the support shown in FIG. 9.
Figure 11:
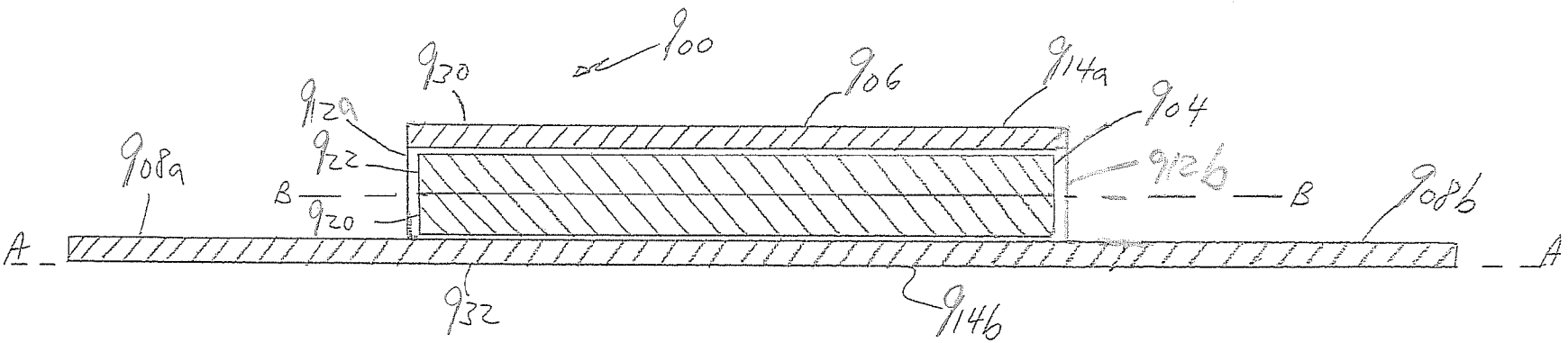
FIG. 11 is a section view of the support of FIG. 9 along section 11-11 in FIG. 9.

FIGS. 9-11 show another embodiment of a support 900. The support 900 includes a sham 902 that is arranged to receive a pillow 904 (which may be the same as the pillows 104 shown in FIG. 3 and in FIGS. 4 and 5) positionable in a sleeve 906 of the sham 902. The sham 902 includes a pair of extensions or flaps 908*a*, 908*b* that extend axially from opposite sides of the sleeve 906 along longitudinal axis A-A. The sleeve 906 has two substantially closed sides and two substantially open sides and is constructed to receive and retain the pillow 904. More particularly, the sleeve 906 has side openings 912*a* and 912*b* perpendicular to longitudinal axis A-A through which the pillow 904 is introduced so that pillow 904 is disposed in the sleeve 906 with its axis B-B parallel to axis A-A. In one embodiment, the sham 902 is formed by laying one layer of material 914*a* (FIGS. 9 and 11) atop a larger layer of material 914*b* (FIGS. 9 and 11) and stitching them together on two sides to form seams 940, thereby creating the sleeve 906 with the side openings 912*a* and 912*b*.

The sleeve 906 has a width (W), which, in at least one embodiment, is substantially equal to the width of a hospital bed mattress. For example, the width (W) of the sleeve 906 can be between substantially 28 and 39 inches. Typically, for most hospital-type beds, the width (W) of the pocket will be substantially 30 or 36 inches. In one embodiment, the sleeve 906 has a length (L) between substantially 18 and 23 inches.

FIG. 10 shows a front side elevation view of the support 900 and FIG. 11 shows a view of the support 900 along section 11-11 in FIG. 10. In one embodiment the lengths (L2) and (L3) of each of the extensions 908*a*, 908*b* can be between 18 and 23 inches. In one other embodiment, the lengths (L2) and (L3) of the extensions 908*a*, 908*b* are the same as the length (L) of the sleeve 906. In one embodiment, the combined (added) width of the widths (W2) and (W3) of the extensions 908*a*, 908*b* is substantially equal to the width (W)

of the sleeve 906. In one embodiment, the widths (W2) and (W3) of the extensions 908*a*, 908*b* are the same. In one embodiment, the combined widths (W2) and (W3) of the extensions 908*a*, 908*b* and the width (W) of the sleeve 906 is between 62 and 84 inches. Generally, the width (W) of sleeve 906 is chosen to extend across the width of the mattress, and the extensions are sized to extend around the sides of the mattress and far enough under the mattress such that the weight of the patient on the mattress and therefore on the support extensions will prevent the support from being displaced from its intended position under the patient. Thus, in one embodiment, the extensions are sized to extend around the sides of the mattress and under at least a majority of the width of the bottom of the mattress.

In use, the pillow 904 is inserted into the sleeve 906 through opening 912*a* or 912*b* and the support 900 is placed horizontally across the top of the mattress (not shown) of a bed (not shown) so that the sleeve 906 and the pillow 904 are positioned between the sides of the mattress. Typically, the sham and pillow are located underneath a bottom sheet that is used to cover the mattress. The support 900 may be placed so that a top surface 930 (FIGS. 10 and 11) is face down on the mattress and a bottom surface 932 (FIGS. 10 and 11) is face up on the bed. Also, the support 900 is oriented so that if the pillow 904 has a curved portion and a flat portion (as in FIG. 5), the curved portion of the pillow 904 is directed toward the head end of the bed and the flat portion is directed toward the foot end of the bed. The extensions 908*a*, 908*b* are wrapped around the sides of the mattress and tucked under at least a portion of the bottom of the mattress to retain the support 900 in place with respect to the mattress. When the support 900 is so positioned, a patient can lay over the support 900 on the mattress and be supported by the pillow 904 in the sleeve 906. More specifically, when the pillow 904 is formed as shown in FIGS. 4 and 5, the support 900 can be located across the mattress at an appropriate position along the length of the mattress so that the curve of the lower back of the patient is located over the curved portion of the pillow and the position of the buttocks of the patient is located over the flat portion of the pillow to cushion those portions to relieve or avoid the development of sacral decubitus. Furthermore, with the extensions 908*a*, 908*b* so wrapped around the mattress, it will be appreciated that extension 908*a* blocks openings 912*a* and 912*b* so that the pillow 904 is retained in the sleeve 906 and cannot be removed from the sleeve 906 without untucking at least one of the extensions 908*a* and 908*b*. If needed, the entire support 900 can be slid up or down the length of the mattress to an appropriate position. In one embodiment, the layers of material 914*a*, 914*b* are formed of a material that permits the sham 902 to slide easily over the mattress and under a bottom sheet on the mattress. For example, the layers 914*a* and 914*b* can be formed of a synthetic material such as nylon.

In another embodiment, the support 900 is placed so that the top surface 930 is face up on the bed and the bottom surface 932 is face down on the mattress and the extensions 908*a*, 908*b* are wrapped around the sides of the mattress and tucked under at least a majority of the width of the bottom of mattress. With the extensions 908*a*, 908*b* so wrapped around the mattress, it will be appreciated that access to the pillow 904 is not blocked by extensions 908*a* and 908*b*, thus permitting insertion and removal of the pillow 904 from the sleeve 906 without untucking the extensions 908*a* and 908*b*.

The extensions 908*a*, 908*b* may include fasteners for attachment to each other or to mating fasteners on a bed or the sheets on the bed. For example, in one embodiment, the extensions 908*a*, 908*b* include snap closures or hook and loop fasteners (not shown) such that the extensions can wrap around the mattress and the closures or fasteners can connect to each other. Also, instead of connecting the extensions 908*a*, 908*b* together, in at least one other embodiment, the bed (not shown) includes fasteners that can connect to fasteners on the extensions 908*a*, 908*b*.

In one embodiment, the sham 902 is made from a material that can be cleaned with antiseptic solution without being laundered with hospital bed linen. In one embodiment, the sham 902 is made of a synthetic material, such as polyester or nylon, which may be cleaned with an antiseptic such as an alcohol wipe and which may also be laundered. Such a sham has the added benefit as previously disclosed of being easily slid under and over a mattress (and under sheets).

There have been described and illustrated herein several embodiments of supports and method of fixing the supports. While particular embodiments have been described, it is not intended that the invention be limited thereto, as it is intended that the invention be as broad in scope as the art will allow and that the specification be read likewise. Thus, while particular shapes, sizes, and configurations of supports, pockets, and seams have been disclosed, it will be appreciated that other shapes, sizes, and configurations may be used as well. In addition, while particular types of fasteners have been disclosed, it will be understood that other types of fasteners may be utilized. Furthermore, while a method for utilizing the leg support and the sacral support has been disclosed with respect to a patient in certain settings has been disclosed, it will be understood that the method can similarly be utilized by a person in a dwelling such as a home or other setting. Further yet, while one embodiment of a support was described with respect to one type of pillow and another embodiment of a support was described with respect to another type of pillow, it will be appreciated that either type of pillow can be used in conjunction with either of the embodiments. Also, while the pockets of the shams were described as having two or three substantially closed sides and one or two substantially open sides, it will be appreciated that the extent of a side being closed is that it will prevent the pillow from being removed without conscious effort, and the extent of a side being open is that it will permit the pillow to be inserted without undue effort. Further yet, while the supports have been described as having a pocket extending substantially across the entire width of a mattress, it will be appreciated that, while less convenient, the pocket could extend past the top surface of the mattress and extend down the sides and even under the mattress. It will therefore be appreciated by those skilled in the art that yet other modifications could be made to the provided embodiments without deviating from the spirit and scope of the claims.

What is claimed is:

1. A support for use on a mattress, said support comprising:

a sham extending longitudinally along an axis and defined by a width along the axis and a length transverse to the axis, said sham having a sleeve having two substantially closed sides parallel and opposite each other and extending longitudinally along the axis and two substantially open sides parallel and opposite each other and extending transverse to the axis, said sleeve comprising of a first layer of material and a second relatively larger layer of material, the two layers of material being fastened together only along said substantially closed sides, and said second layer of material comprises extensions extending longitudinally from said opposite substantially open sides of said sleeve, wherein said sleeve is configured to receive a pillow therein and said extensions are configured to wrap around opposing sides of and tucked below at least a portion of a bottom of the mattress to retain said support in place with respect to said mattress and wherein said second layer of material is located above said first layer of material such that the pillow is located within the sleeve beneath said second layer of material and above said first layer of material such that said extensions block said substantially open sides of said sleeve when the extensions are wrapped around the opposing sides of and tucked below at least the portion of the bottom of the mattress so that said pillow is retained in said sleeve and cannot be removed from said sleeve without untucking at least one of the extensions; and wherein said pillow comprises a matrix of generally spaced air cells having a first portion and a second portion each comprising at least one air cell layer, said second portion comprising vertically stacked air cell layers and said first portion comprising fewer vertically stacked air cell layers than said second portion.

2. The support according to claim 1, further comprising a pillow inserted in said sleeve, said pillow having a width substantially equal to a width of said sleeve and said pillow having a length substantially equal to a length of said sleeve.

3. The support according to claim 2, wherein the pillow is formed from a foam material at least five inches thick and does not compress more than 50%.

4. The support according to claim 3, wherein said width of said sham is between 62 and 84 inches, and said sleeve has a width of between 28 and 39 inches.

5. The support according to claim 1, wherein said sham is constructed of a synthetic material that can be sanitized with an aseptic solution without being laundered.

6. The support according to claim 5, wherein each of said extensions has a length of the same as a length of said sleeve.

7. The support according to claim 1, wherein said sleeve has a width, parallel to the axis that is between 28 and 39 inches and said sleeve has a length, transverse to the axis, between 18 and 23 inches.

8. The support according to claim 1, wherein the width of the sham is at least three times a length of said sleeve.

9. The support according to claim 1, wherein the open sides of said sleeve extend substantially perpendicular to said axis.

10. The support according to claim 1, wherein the closed sides of said sleeve extend substantially parallel to said axis.

11. A support for use on a mattress, said support comprising:

a sham extending longitudinally along an axis and defined by a width along the axis and a length transverse to the axis, said sham having a sleeve having two substantially closed sides parallel and opposite each other and extending longitudinally along the axis and two substantially open sides parallel and opposite each other and extending transverse to the axis, said sleeve comprising a first layer of material and a second relatively larger layer of material, the two layers of material being fastened together only along said substantially closed sides, and said second layer of material comprises extensions extending longitudinally from said opposite substantially open sides of said sleeve, wherein said sleeve is configured to receive a pillow therein and said extensions are configured to wrap around opposing sides of and tucked below at least a portion of a bottom of the mattress to retain said support in place with respect to said mattress and wherein said second layer of material is located above said first layer of material such that the pillow is located within the sleeve beneath said second layer of material and above said first layer of material such that said extensions block said substantially open sides of said sleeve when the extensions are wrapped around the opposing sides of and tucked below at least the portion of the bottom of the mattress so that said pillow is retained in said sleeve and cannot be removed from said sleeve without untucking at least one of the extensions, wherein said pillow is formed of an air cushion material comprised of a matrix of regularly spaced air cells; and wherein said pillow has a body, a curved portion, and a generally flat portion, said curved portion comprising a first end of said pillow folded back over a portion of the body of the pillow and attached to said body, wherein the curved portion of the pillow is configured to be located beneath a lower back of a patient and the generally flat portion of the pillow is configured to be located beneath a buttocks of the patient.

12. The support according to claim 11, wherein the pillow is formed as a bolster at least 5 inches thick.

13. The support according to claim 11, wherein each air cell is formed of a pair of oppositely spaced layers of material that are sealed together forming a pocket that is inflated with a gas, wherein each air cell has dimensions of about 1.5 inches wide, 2 inches long, and 1 inch high.

14. A method of placing a support on a mattress, the method comprising:

providing a sham extending longitudinally along an axis, said sham having a sleeve having two substantially closed sides parallel and opposite each other and extending longitudinally along the axis and two substantially open sides parallel and opposite each other and extending transverse to the axis, said sleeve comprising a first layer of material and a second relatively larger layer of material, the two layers of material being fastened together only along said substantially closed sides, and said second layer of material comprises extensions extending longitudinally from said opposite substantially open sides of said sleeve, wherein said sleeve is configured to receive a pillow therein and said extensions are configured to wrap around opposing sides of and tucked below at least a portion of a bottom of the mattress to retain said support in place with respect to said mattress and wherein said second layer of material is located above said first layer of material such that the pillow is located within the sleeve beneath said second layer of material and above said first layer of material such that said extensions block said substantially open sides of said sleeve when the extensions are wrapped around the opposing sides of and tucked below at least the portion of the bottom of the mattress so that said pillow is retained in said sleeve and cannot be removed from said sleeve without untucking at least one of the extensions, and wherein said pillow comprises a matrix of generally spaced air cells having a first portion and a second portion each comprising at least one air cell layer, said second portion comprising vertically stacked air cell layers and said first portion comprising fewer vertically stacked air cell layers than said second portion;

placing the sham longitudinally across the mattress; and wrapping said extensions around the substantially open sides of the pillow and the sides of and at least the portion of the bottom of the mattress.

15. The method of claim 14, further comprising inserting the pillow into said sleeve.

16. The method of claim 15, further comprising sliding said sham perpendicularly relative to said axis along the mattress to a desired location.

17. The method of claim 16, wherein said sham is constructed of a synthetic material that can be sanitized with an aseptic solution without being laundered and can easily slide along the mattress.

18. The method of claim 14, wherein a width of the sham is at least three times a length of the sleeve, a width of said sham is between 62 and 84 inches, said sleeve has a width of between 28 and 39 inches, and said sleeve has a length, transverse to the axis, between 18 and 23 inches.

19. The method of claim 18, wherein a total width of said extensions is substantially at least as large as a width of said sleeve.

* * * * *